US006298701B1

(12) United States Patent
Marando

(10) Patent No.: US 6,298,701 B1
(45) Date of Patent: Oct. 9, 2001

(54) MECHANICAL PRESS STRUCTURE ADAPTED TO PERFORM HYDROFORMING OPERATIONS

(75) Inventor: Richard A. Marando, Mohrsville, PA (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/650,958

(22) Filed: Aug. 29, 2000

Related U.S. Application Data

(60) Provisional application No. 60/151,787, filed on Aug. 31, 1999.

(51) Int. Cl.[7] ..... B21D 26/02
(52) U.S. Cl. ..... 72/61; 72/58; 29/421.1
(58) Field of Search ..... 72/58, 61, 63; 29/421.1

(56) References Cited

U.S. PATENT DOCUMENTS

| | | | | |
|---|---|---|---|---|
| 1,777,310 | | 10/1930 | Hopkinson . | |
| 2,869,173 | | 1/1959 | Van Hartesveldt et al. . | |
| 3,190,215 | | 6/1965 | Howard et al. . | |
| 4,193,341 | | 3/1980 | Clements et al. . | |
| 4,420,958 | | 12/1983 | Schultz et al. . | |
| 4,601,422 | | 7/1986 | Dumargue et al. . | |
| 5,562,796 | | 10/1996 | Ertel . | |
| 5,815,901 | * | 10/1998 | Mason et al. | 72/58 |
| 5,927,120 | * | 7/1999 | Marando | 72/61 |
| 5,987,950 | * | 11/1999 | Horton | 72/58 |
| 6,006,567 | * | 12/1999 | Brown et al. | 72/58 |
| 6,041,633 | * | 3/2000 | Bieling | 72/61 |
| 6,170,309 | * | 1/2001 | Marando | 72/61 |

* cited by examiner

*Primary Examiner*—David Jones
(74) *Attorney, Agent, or Firm*—MacMillan, Sobanski & Todd, LLC

(57) ABSTRACT

A mechanical press is adapted to perform a hydroforming operation. The press includes a stationary base supporting a bolster that carries a lower die section, a movable slide that carries an upper die section, and a drive mechanism for selectively raising and lowering the slide relative to the base. An inflatable bladder is disposed between the base and the bolster. Initially, the drive mechanism is operated to lower the slide to its bottom dead center position such that the die sections enclose a workpiece within a die cavity. Then, pressurized fluid is supplied within the workpiece to expand it outwardly into conformance with the die cavity. At the same time, pressurized fluid is also supplied to the interior of the inflatable bladder. The application of such pressurized fluid causes the inflatable bladder to be physically expanded, causing the bolster carrying the lower die section to be raised relative to the base. The magnitude of this force is preferably selected to be approximately equal to the magnitude of the outwardly directed force exerted by the workpiece against the lower die section and, thus, the bolster. As a result, the lower die section is urged upwardly to remain in position relative to the upper die section during the hydroforming operation. In effect, the inflatable bladder pre-stresses the frame of the press and fills any extra space created by the deflections of the various components of the frame, thereby retaining the die sections and in position during the hydroforming operation. As a result, the press can be adapted to hydroform relatively large and thick-walled workpieces, such as vehicle frame components.

18 Claims, 4 Drawing Sheets

MECHANICAL PRESS STRUCTURE ADAPTED TO PERFORM HYDROFORMING OPERATIONS

CROSS REFERENCE TO RELATED APPLICATION

This application claims the benefit of U.S. provisional application No. 60/151,787, filed Aug. 31, 1999, the disclosure of which is incorporated herein by reference.

BACKGROUND OF THE INVENTION

This invention relates in general to machines for performing hydroforming operations on workpieces. In particular, this invention relates to an improved structure for a mechanical press that is adapted to perform a hydroforming operation on a workpiece.

Mechanical presses are well known machines that are commonly used to manufacture a wide variety of workpieces including, for example, relatively large or thick-walled workpieces such as side rails, cross members, and other components for vehicle frame assemblies. A typical mechanical press includes a stationary portion (typically referred to as a bed) having a first die section secured thereto, a movable portion (typically referred to as a slide) having a second die section secured thereto, and an actuating mechanism for selectively moving the slide toward and away from the bed. When the slide is moved toward the bed, the first and second die sections engage the workpiece and exert forces thereon to mechanically deform it into a desired shape. When the slide is moved away from the bed, the first and second die sections are spaced apart from one another to allow the deformed workpiece to be removed and permit the next workpiece to be deformed to be inserted therebetween.

Traditionally, the workpieces that are formed using conventional mechanical presses are stamped from flat stock or open channel structural numbers, i.e., structural members that have a non-continuous cross sectional shape (for example, a U-shaped or C-shaped channel member). The formation of a workpiece from such flat stock and open channel structural members has functioned satisfactorily for many years. However, more recently, it has been found desirable to form a workpiece from a closed channel structural member, i.e., a structural member having a continuous cross sectional shape (for example, a tubular or box-shaped channel member). These types of closed channel cross sectional shapes have been found to be advantageous because they provide strength and rigidity to the formed workpiece, and further can easily provide vertically and horizontally oriented side surfaces that can facilitate the attachment of other components thereto.

Hydroforming is a well known metal working process that is commonly used to deform closed channel structural members into desired shapes. Hydroforming employs pressurized fluid to deform the closed channel workpiece into conformance with a die cavity having a desired shape. A typical hydroforming apparatus includes a stationary portion (typically referred to as a bed) having a first die section secured thereto, a movable portion (typically referred to as a slide or ram) having a second die section secured thereto, and an actuating mechanism for selectively moving the slide toward and away from the bed. The die sections have cooperating recesses formed therein that together define a die cavity having a shape corresponding to a desired final shape for the workpiece. When the slide is moved toward the bed, the die sections engage one another so as to enclose the workpiece within the die cavity. Although the die cavity is usually somewhat larger than the workpiece to be hydroformed, movement of the slide toward the bed may, in some instances, cause some mechanical deformation of the workpiece. In any event, the workpiece is then filled with a fluid, typically a relatively incompressible liquid such as water. The pressure of the fluid within the workpiece is then increased to such a magnitude that the workpiece is deformed into conformance with the die cavity. As a result, the workpiece acquires the desired final shape. When the slide is moved away from the bed, the die sections are spaced apart from one another to allow the deformed workpiece to be removed and the next workpiece to be deformed to be inserted therebetween.

Because the traditional method of manufacturing the workpiece using a conventional mechanical press has been in widespread use for decades, most manufacturers of these types of workpieces have acquired a relatively large number of such mechanical presses. The monetary investment in these mechanical presses is quite substantial. Thus, although the process of hydroforming closed channel structural members has been found to possess a number of desirable characteristics, some manufacturers have moved slowly to adopt it because of their prior monetary investment in mechanical presses. Also, the acquisition of hydroforming machines requires an additional substantial monetary investment, which has further slowed the widespread adoption of hydroforming by some manufacturers. Thus, it would be desirable to provide an improved structure for a mechanical press that can adapt it to perform a hydroforming operation on a workpiece.

SUMMARY OF THE INVENTION

This invention relates to an improved structure for a mechanical press that can adapt is to perform a hydroforming operation on a workpiece. The press includes a stationary base supporting a bolster that carries a lower die section, a movable slide that carries an upper die section, and a drive mechanism for selectively raising and lowering the slide relative to the base. An inflatable bladder is disposed between the base and the bolster. Initially, the drive mechanism is operated to lower the slide to its bottom dead center position such that the die sections enclose a workpiece within a die cavity. Then, pressurized fluid is supplied within the workpiece to expand it outwardly into conformance with the die cavity. At the same time, pressurized fluid is also supplied to the interior of the inflatable bladder. The application of such pressurized fluid causes the inflatable bladder to be physically expanded, causing the bolster carrying the lower die section to be raised relative to the base. The magnitude of this force is preferably selected to be approximately equal to the magnitude of the outwardly directed force exerted by the workpiece against the lower die section and, thus, the bolster. As a result, the lower die section is urged upwardly to remain in position relative to the upper die section during the hydroforming operation. In effect, the inflatable bladder pre-stresses the frame of the press and fills any extra space created by the deflections of the various components of the frame, thereby retaining the die sections and in position during the hydroforming operation. As a result, the press can be adapted to hydroform relatively large and thick-walled workpieces, such as vehicle frame components.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
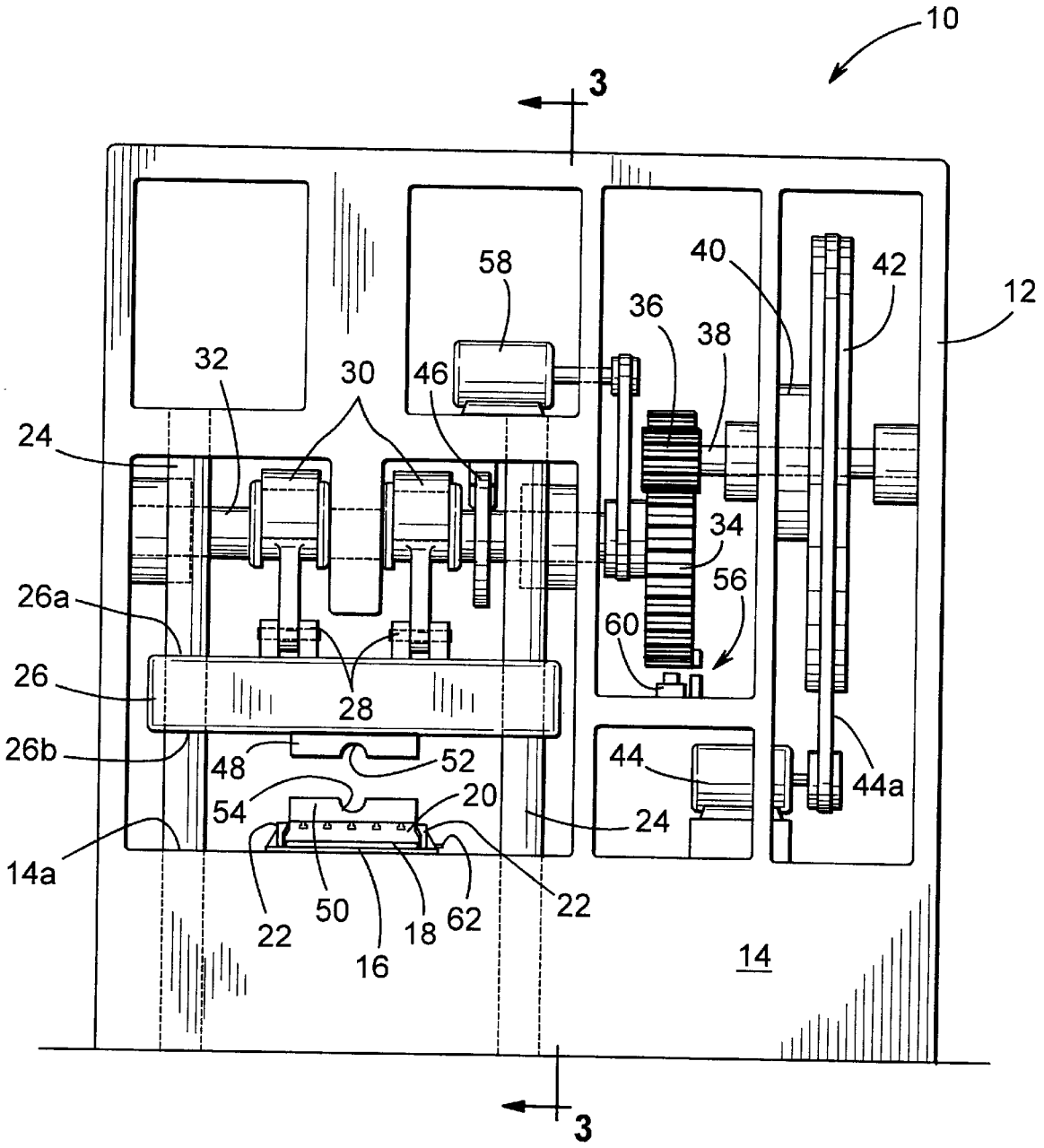
FIG. 1 is a front elevational view of a mechanical press that is adapted to perform a hydroforming operation on a workpiece in accordance with this invention, wherein the components of the mechanical press are shown prior to the commencement of the hydroforming operation.

Referring now to the drawings, there is illustrated a mechanical press, indicated generally at 10, that is adapted to perform a hydroforming operation in accordance with this invention. The general structure and operation of the press 10 is, for the most part, conventional in the art, and only those portions of the press 10 that are necessary for a complete understanding of this invention are illustrated and will be described. The press 10 includes a frame 12 having a base 14 defining an upper surface 14*a*. A base plate 16 is secured to the upper surface 14*a* of the base 14. An inflatable bladder 18 or other hydraulic boosting mechanism is provided on the upper surface of the base plate 16. The structure and method of operation of the inflatable bladder 18 will be explained in detail below.

Figure 2:
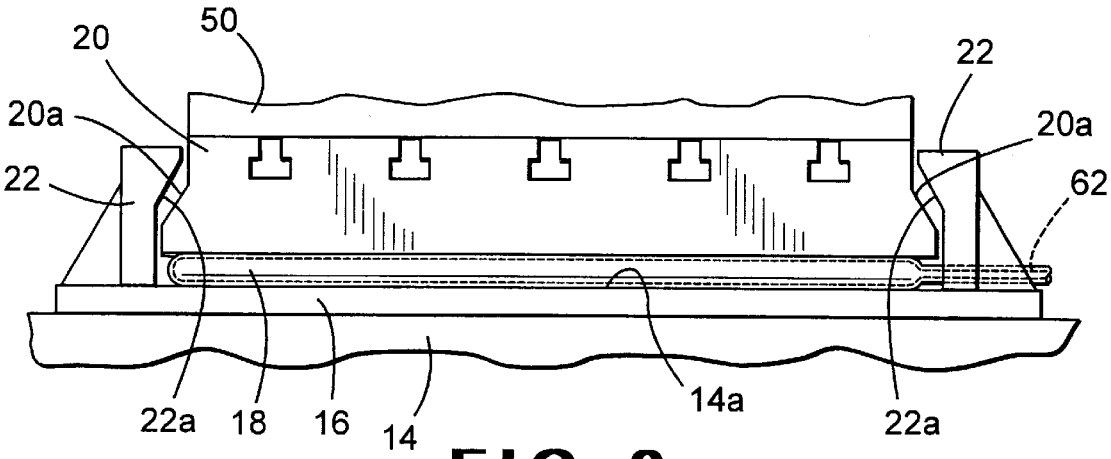
FIG. 2 is an enlarged front elevational view of a portion of the mechanical press illustrated in FIG. 1.
Figure 5:
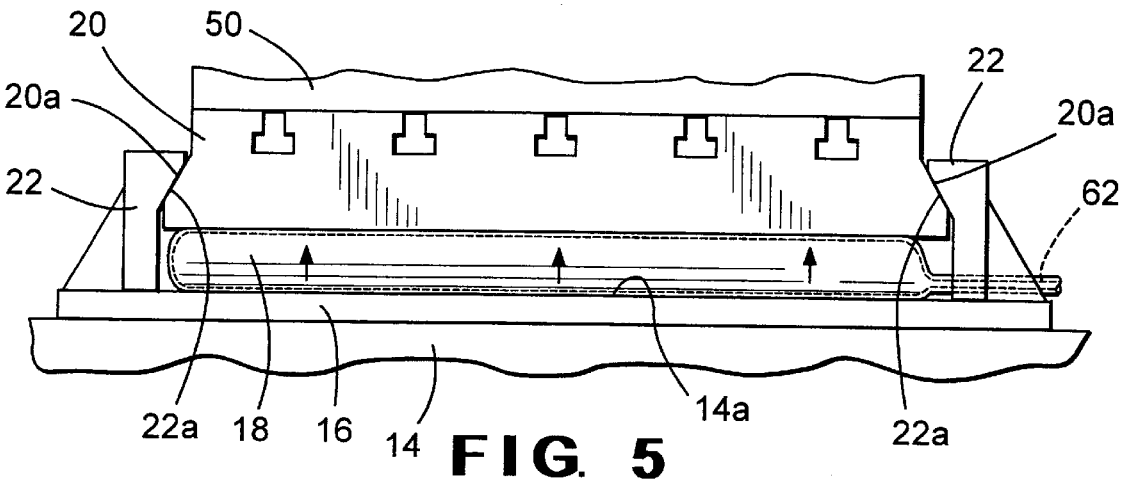
FIG. 5 is an enlarged front elevational view of a portion of the mechanical press illustrated in FIG. 4.

As best shown in FIGS. 2 and 5, a bolster 20 is positioned adjacent to the upper surface of the inflatable bladder 18. Thus, it can be seen that the inflatable bladder 18 is disposed between the base plate 16 and the bolster 20 of the press 10. Alternatively, the base plate 16 may be omitted, and the inflatable bladder 18 may be disposed directly adjacent to the upper surface of the base 14. The structure and operation of the inflatable bladder 18 will be described further below. The bolster 20 is preferably provided with one or more engagement surfaces, such as the illustrated opposed tapered or angled surfaces 20*a*. The tapered surfaces 20*a* of the bolster 20 are provided to cooperate with one or more corresponding engagement surfaces, such as the illustrated pair of tapered or angled surfaces 22*a*, provided on a pair of keepers 22 that are secured to the base plate 16 of the press 10. In the illustrated embodiment, two of such keepers 22 are secured to the press 10 on opposite sides of the bolster 20. However, any desired number of such keepers 22 may be provided at any desired locations on the press 10. The keepers 22 are sized and shaped to engage portions of the bolster 20 to prevent it from moving horizontally (i.e., from front to back and from side to side) relative to the base plate 16 of the press 10 during normal operation of the press 10. However, the keepers 22 are also preferably sized and shaped to permit the bolster 20 to move vertically relative to the base plate 16 in the manner described below. Such vertical movement of the bolster 20 relative to the base plate 16 is preferably limited by the engagement of the tapered surfaces 20*a* of the bolster 20 and the tapered surfaces 22*a* of the keepers 22. Thus, as will be explained in greater detail below, the tapered surfaces 20*a* of the bolster 20 engage the tapered surfaces 22*a* of the keepers 22 to limit the magnitude of such relative vertical movement. The keepers 22 can also function to retain the inflatable bladder 18 in a predetermined position relative to the base plate 16 of the press 10.

Figure 3:
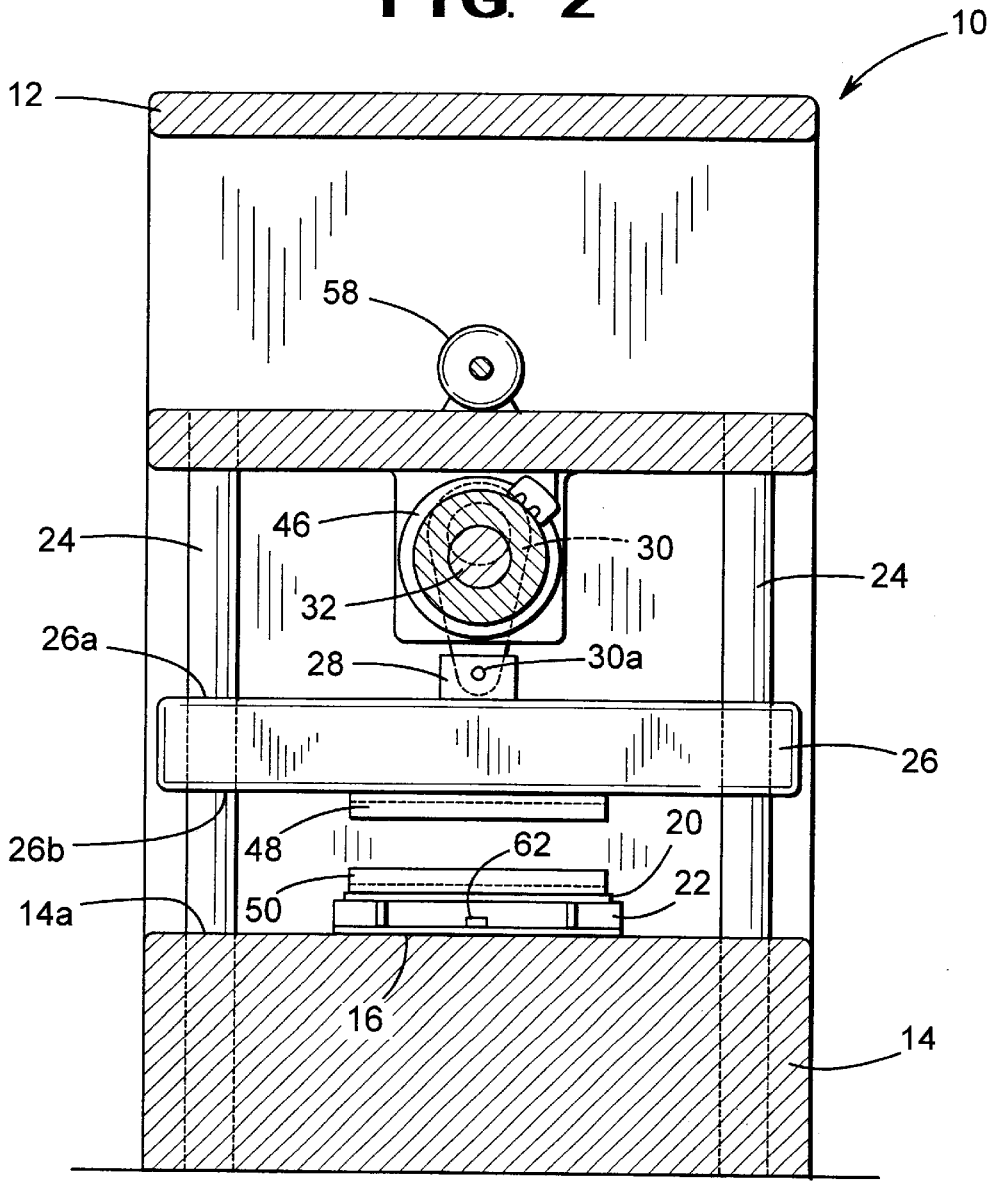
FIG. 3 is a sectional elevational view of the mechanical press taken along line 3—3 of FIG. 1.
Figure 6:
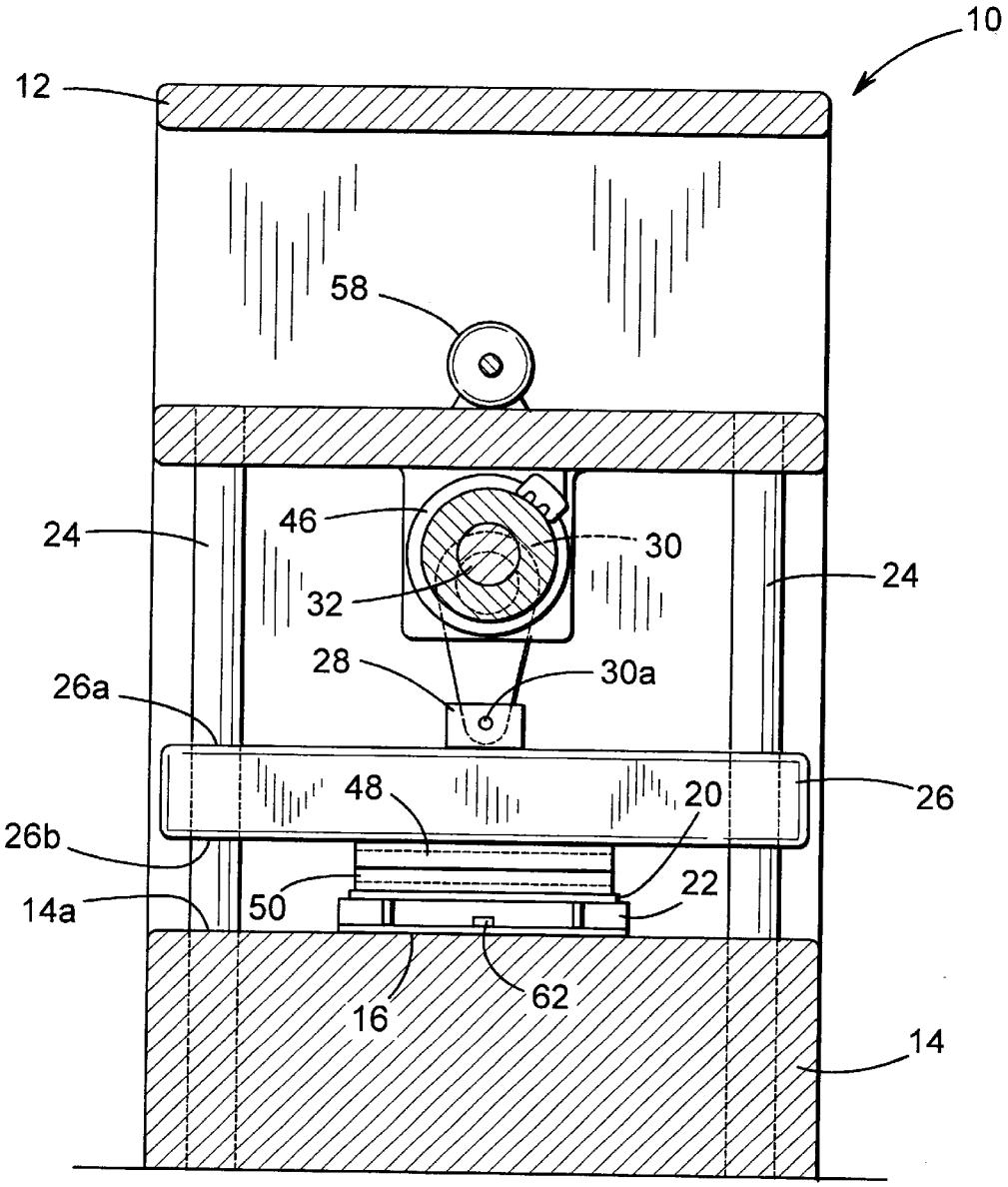
FIG. 6 is a sectional elevational view of the mechanical press taken along line 6—6 of FIG. 4.

The frame 12 of the press 10 further includes a plurality (preferably four) of posts 24 that extend upwardly from the upper surface 14*a* of the base 14. A slide 26 is engaged with or otherwise supported on the posts 24 for vertical sliding movement relative to the frame 12 and the base 14. The slide 26 has an upper surface 26*a* and a lower surface 26*b*. One or more mounting brackets 28 (two in the illustrated embodiment) may be secured to the upper surface 26*a* of the slide 26. The mounting brackets 28 are connected to the lower ends of respective crankshaft pins 30 by respective pivot pins 30*a*, as shown in FIGS. 3 and 6. The upper ends of the crankshaft pins 30 are rotatably mounted on eccentric portions of a crankshaft 32. In a manner that is well known in the art, rotational movement of the crankshaft 32 causes vertical reciprocating movement of the slide 26 relative to the posts 24 and the base 14.

A drive system is provided for selectively rotating the crankshaft 32 to effect such vertical reciprocating movement of the slide 26 relative to the base 14. In the illustrated embodiment, the drive system includes a main drive gear 34 that is secured to one end of the crankshaft 32 for rotation therewith. An intermediate gear 36 meshes with the main drive gear 34 and is secured to a drive shaft 38 for rotation therewith. The drive shaft 38 extends between the intermediate gear 36 and an output portion of a clutch 40. An input portion of the clutch 40 is connected to a flywheel 42 that is constantly rotatably driven by a motor 44 by means of a belt 44*a* in a known manner. When the clutch 40 is engaged, the flywheel 42 is connected to rotatably drive the drive shaft 38 and the crankshaft 32, thereby cause vertical reciprocating movement of the slide 26 as described above. When the clutch 40 is disengaged, the flywheel 42 is disconnected from the drive shaft 38 and the crankshaft 32 to prevent such vertical reciprocating movement of the slide 26. A brake 46 may be provided to affirmatively prevent rotational movement of the crankshaft 32 when the clutch 40 is disengaged. It will be appreciated that any other conventional drive system may be provided for selectively rotating the crankshaft 32 to effect the vertical reciprocating movement of the slide 26 relative to the base 14. It will be appreciated that a wide variety of basic press structures such as thus far described are known in the art. This invention is intended to encompass any desired or conventional structure for the press 10 that can accomplish vertical reciprocating movement of the slide 26 relative to the base 14 as described above.

Figure 4:
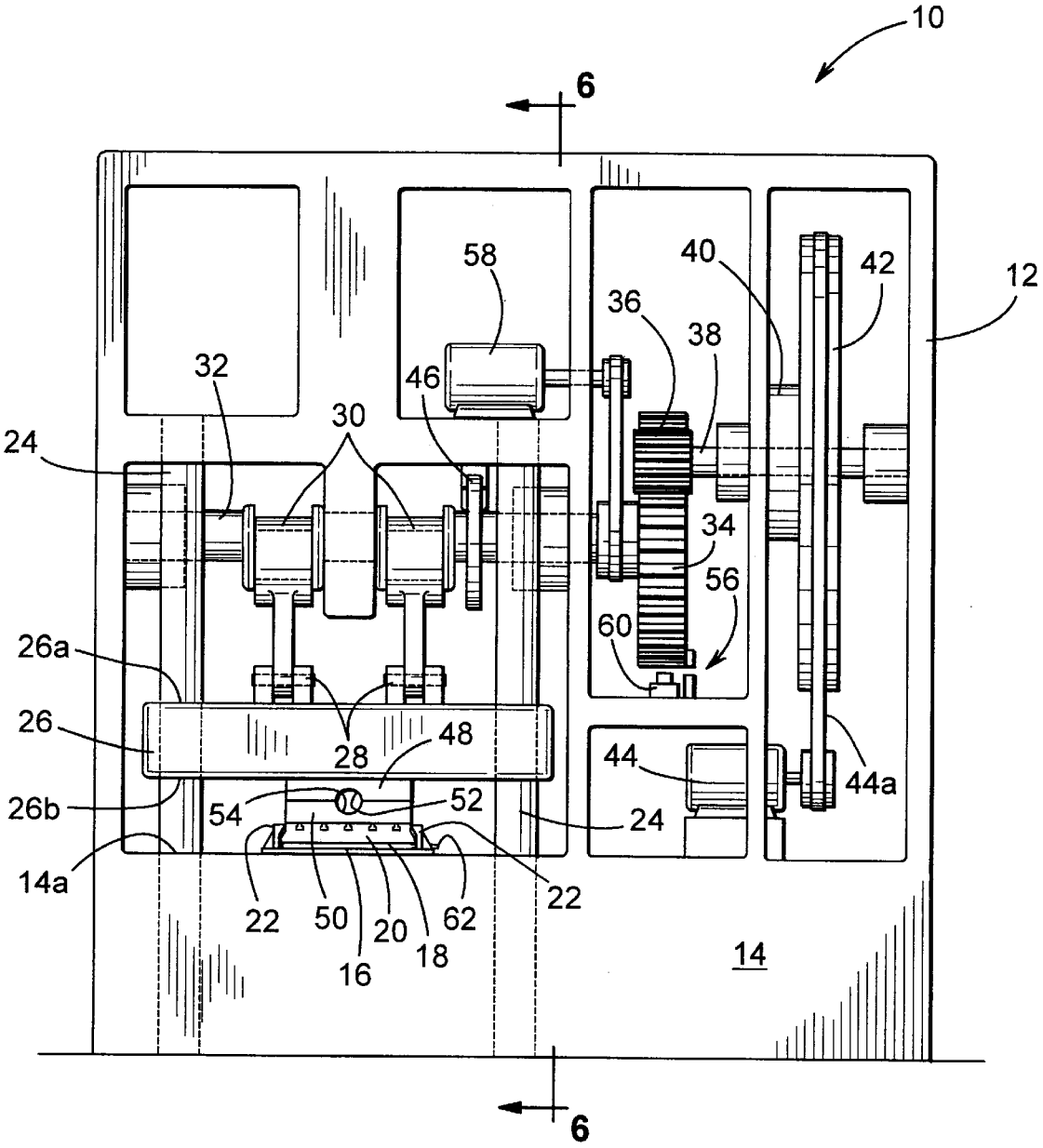
FIG. 4 is a front elevational view of the mechanical press illustrated in FIGS. 1, 2, and 3 showing the components thereof during the hydroforming operation.

The press 10 also includes a die including an upper die section 48 that is secured to the lower surface 26*b* of the slide 26 and a lower die section 50 that is secured to the upper surface of the bolster 20. The upper and lower die sections 48 and 50 have respective cavity portions 52 and 54 formed therein. When the upper die section 48 is lowered into engagement with the lower die section 50, as illustrated in FIGS. 4, 5, and 6, the cavity portions 52 and 54 cooperate to define a hydroforming die cavity. As is well known in the art, the die cavity defines a desired shape for a workpiece (not shown) to be deformed by using a hydroforming operation, as will be described in detail below.

As is also well known, the bottom dead center position of the slide 26 is that point at which the crankshaft pins 30 are precisely vertically aligned between the crankshaft 32 and the slide 26. In this bottom dead center position, the slide 26 is at its lowermost position relative to the bolster 20. Because of this vertical alignment of the crankshaft pins 30, reaction forces acting upwardly against the slide 26 will not tend to rotate the crankshaft 32, but rather are transmitted to the frame 12 of the press 10. Therefore, by retaining the crankshaft 32 in this bottom dead center position, the press 10 can strongly resist forces acting upwardly on the slide 26 which would tend to move the upper and lower die sections 48 and 50 out of contact with one another, such as occur during a hydroforming operation.

In order to determine the bottom dead center position, the mechanical press 10 may include a sensing arrangement, shown generally at 56, for determining when the slide 26 is in its lowermost position relative to the bolster 20, wherein the die sections 48 and 50 engage one another to allow the commencement of the hydroforming operation. In the illustrated embodiment, the sensing arrangement 56 may include a conventional sensor (not shown) that is capable of generating an electrical signal when the slide 26 is in its lowermost position relative to the bolster 20. Such a sensor may be responsive to movement of the slide 26, one of the gears 34 or 36, the output shaft 38, or any other component of the press 10 for generating such signal. To facilitate the proper positioning of the slide 26 at this bottom dead center position relative to the bolster 20, it may be desirable to provide ajogging motor 58. The jogging motor 58 is conventional in the art and is provided to effect relatively small rotational movements of the crankshaft 32 in order to achieve the precise bottom dead center positioning of the slide 26 after relatively fast rotational movement by the motor 44. If desired, the mechanical press 10 may include a locking device 60 for securely locking the crankshaft 32 in its bottom dead center position once it has been achieved. It will be appreciated that any other suitable sensing, moving, and locking arrangement may be provided if desired.

As mentioned above, the inflatable bladder 18 is provided between the upper surface of the base plate 16 and the lower surface of the bolster 20 of the press 10. The inflatable bladder 18 is designed to be filled with pressurized fluid during the performance of the hydroforming operation for the reasons described below. To accomplish this, a feed line 62 is provided to provide fluid communication with the interior of the inflatable bladder 18. The feed line 62 can form a portion of or be connected to any desired source of pressurized fluid, preferably the same source of pressurized fluid that used to perform the hydroforming operation. The supply of such pressurized fluid within the inflatable bladder 18 may be controlled by conventional valves (not shown), and the operation of such valves may be controlled by a conventional control system (not shown). The inflatable bladder 18 may be formed in any desired shape and from any desired material so as to be capable of physical expansion in response to the application of pressurized fluid therein. For example, the inflatable bladder 18 may be formed from a pair metallic sheets having edges that are secured together to form a fluid-tight enclosure. Alternatively, the inflatable bladder 18 may be formed from a fluid-tight flexible material, such as rubber or other elastomeric material.

The operation of the mechanical press 10 will now be described. Initially, the crankshaft 32 is rotated by the motor 44 so as to raise the slide 26 carrying the upper die section 48 relative to the lower die section 50, as shown in FIGS. 1 and 3. During this initial period, the inflatable bladder 18 is deflated, as best shown in FIG. 2. As a result, the bolster 20 carrying the lower die section 50 is in a lowered position relative to the base 14. When the slide 26 reaches its uppermost position relative to the base 14, the clutch 40 is disengaged so as to disconnect the drive shaft 38 from causing further rotation of the crankshaft 32. At the same time, the brake 46 operated to engage the crankshaft 32, thereby positively preventing further rotation of the crankshaft 32. In this position, a workpiece (not shown) can be placed within the lower cavity portion 54 formed in the upper surface of the lower die section 50. As is known in the art, the workpiece may be preliminarily deformed in a conventional tube bending apparatus so as to possess the general shape of the die cavity.

Thereafter, the brake 46 is disengaged, and the clutch 40 is engaged to connect the drive shaft 38 to rotate the crankshaft 32. As previously discussed, rotation of the crankshaft 32 causes the slide 26 to move downwardly to lower the upper die section 48 into engagement with the lower die section 50, as shown in FIGS. 4 and 6. Although the die cavity defined by the upper die section 48 and the lower die section 50 is usually somewhat larger than the workpiece to be hydroformed, movement of the upper and lower die sections 48 and 50 from the opened position to the closed position may, in some instances, cause some mechanical deformation of the workpiece. In any event, during the downward movement of the slide 26, the clutch may be disengaged to disconnect the drive shaft 38 from the crankshaft 32. Notwithstanding this, the slide 26 continues to move downwardly by virtue of its inertia and weight. The sensing arrangement 56 detects the approach of the slide 26 toward its bottom dead center position and, at the appropriate moment, engages the brake 46 to stop rotation of the crankshaft 32. Ideally, the sensing arrangement 56 is capable of stopping the rotation of the crankshaft 32 when the slide 26 is precisely located at its bottom dead center position. However, in practice, the slide 26 may be stopped either slightly before or after its bottom dead center position. In these instances, the brake 46 can be released, and the jogging motor 58 can be operated to precisely position the slide at its bottom dead center position before re-engaging the brake 46. The safety locking device 60 may then be engaged to positively secure the slide 26 in its bottom dead center position.

Next, pressurized fluid is supplied within the workpiece to perform the hydroforming operation. To accomplish this, a pair of conventional end feed cylinders (not shown) sealingly engage the ends of the workpiece in a well known manner. Either or both of the end feed cylinders are connected to a source of pressurized fluid so as to fill the workpiece with a relatively incompressible low-pressure fluid, such as water. The pressure of the fluid within the workpiece is increased in a well known manner to such a magnitude that the workpiece is expanded outwardly into conformance with the die cavity defined by the cooperating cavity portions 52 and 54. As a result, the workpiece is deformed into the desired final shape.

At the same time the pressure of the fluid is being increased, pressurized fluid is also supplied through the feed line 62 to the interior of the inflatable bladder 18. The application of such pressurized fluid causes the inflatable bladder 18 to be physically expanded, as best shown in FIG. 5. As a result, the bolster 20 carrying the lower die section 50 is in an uppermost position relative to the base 14. The uppermost position of the bolster 50 can be defined by the engagement of the tapered surfaces 20*a* of the bolster 20 and the tapered surfaces 22*a* of the keepers 22, as described above. In any event, as a result of such physical expansion, the inflated bladder 49 reacts between the base plate 16 and the bolster 20, exerting a force to urge them apart from one another. The magnitude of this force is preferably selected to be approximately equal to the magnitude of the outwardly directed force exerted by the workpiece against the lower die section 50 and, thus, the bolster 50. As a result, the lower die section 50 is urged upwardly to remain in position relative to the upper die section 48 during the hydroforming operation. In effect, the inflatable bladder 49 pre-stresses the frame 12 of the press 10 and fills any extra space created by the deflections of the various components of the frame 12, thereby retaining the die sections 48 and 50 in position during the hydroforming operation. As a result, the press 10 can be adapted to hydroform relatively large and thick-walled workpieces, such as vehicle frame components. After the hydroforming operation is complete, the safety locking device 60 and the brake 46 are disengaged. Then, the clutch 40 is engaged to connect the drive shaft 38 to rotate the crankshaft 32 so as to return the slide 26 to its uppermost position, as described above. The cycle for the next hydroforming operation may then begin.

Although this invention has been described and illustrated in the context of the illustrated inflatable bladder 18 disposed between the base plate 16 and the bolster 20, it will be appreciated that the inflatable bladder 18 may, if desired, be disposed between the slide 26 and the upper die section 48. Furthermore, it will be appreciated that the illustrated inflatable bladder 18 is intended to be representative of any type of structure that can be physically expanded during the hydroforming operation to achieve the same result as described above.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A mechanical press adapted for use in hydroforming a workpiece comprising:

a frame including a base, a slide that is movable relative to said base, and a drive mechanism for moving said slide relative to said base;

a sensing arrangement for generating a signal when said slide approaches a bottom dead center position relative to said base;

first and second die sections having respective cavity portions formed therein that cooperate to define a die cavity adapted to receive a workpiece, said first die section being supported on said base, said second die section being secured to said slide for movement therewith;

an inflatable bladder disposed between said first die section and said base or said second die section and said slide; and a source of pressurized fluid for supplying pressurized fluid within the workpiece and for supplying pressurized fluid within said inflatable bladder.

2. The press defined in claim 1 further including a bolster that is supported on said base and having said first die section secured thereto, said inflatable bladder being disposed between said base and said bolster.

3. The press defined in claim 2 further including a keeper for limiting movement of said bolster relative to said base when pressurized fluid is supplied to said inflatable bladder.

4. The press defined in claim 3 wherein said bolster and said keeper having cooperating engagement surfaces formed thereon for limiting movement of said bolster relative to said base when pressurized fluid is supplied to said inflatable bladder.

5. The press defined in claim 1 wherein said drive mechanism is responsive to said bottom dead center position signal for moving said slide to said bottom dead center position.

6. The press defined in claim 1 further including a locking mechanism for retaining said slide in said bottom dead center position when pressurized fluid is supplied to said inflatable bladder.

7. The press defined in claim 1 wherein said slide is linearly movable relative to said base, and wherein said drive mechanism includes a motor that is connected to selectively rotate a crankshaft and a pin that is connected between said crankshaft and said slide such that rotation of said crankshaft by said motor causes linear movement of said slide relative to said base.

8. The press defined in claim 1 further including a locking mechanism that is responsive to said signal for retaining said slide in said bottom dead center position.

9. The press defined in claim 1 wherein said source of pressurized fluid is responsive to said signal for supplying pressurized fluid within the workpiece and for supplying pressurized fluid within said inflatable bladder.

10. A mechanical press adapted for use in hydroforming a workpiece comprising:

a frame including a base, a slide that is linearly movable relative to said base, and a drive mechanism for moving said slide relative to said base, said drive mechanism including a motor that is connected to selectively rotate a crankshaft and a pin that is connected between said crankshaft and said slide such that rotation of said crankshaft by said motor causes linear movement of said slide relative to said base;

first and second die sections having respective cavity portions formed therein that cooperate to define a die cavity adapted to receive a workpiece, said first die section being supported on said base, said second die section being secured to said slide for movement therewith;

an inflatable bladder disposed between said first die section and said base or said second die section and said slide; and a source of pressurized fluid for supplying pressurized fluid within the workpiece and for supplying pressurized fluid within said inflatable bladder.

11. The press defined in claim 10 further including a bolster that is supported on said base and having said first die section secured thereto, said inflatable bladder being disposed between said base and said bolster.

12. The press defined in claim 11 further including a keeper for limiting movement of said bolster relative to said base when pressurized fluid is supplied to said inflatable bladder.

13. The press defined in claim 12 wherein said bolster and said keeper having cooperating engagement surfaces formed thereon for limiting movement of said bolster relative to said base when pressurized fluid is supplied to said inflatable bladder.

14. The press defined in claim 10 further including a locking mechanism for retaining said slide in said bottom dead center position when pressurized fluid is supplied to said inflatable bladder.

15. The press defined in claim 10 further including a sensing arrangement for generating a signal when said slide approaches a bottom dead center position relative to said base.

16. The press defined in claim 15 wherein said drive mechanism is responsive to said bottom dead center position signal for moving said slide to said bottom dead center position.

17. The press defined in claim 15 further including a locking mechanism that is responsive to said signal for retaining said slide in said bottom dead center position.

18. The press defined in claim 15 wherein said source of pressurized fluid is responsive to said signal for supplying pressurized fluid within the workpiece and for supplying pressurized fluid within said inflatable bladder.

* * * * *